United States Patent [19]

Cook et al.

[11] 4,025,400

[45] May 24, 1977

[54] PROCESS AND APPARATUS FOR THE RECOVERY OF PARTICULATE CRYSTALLINE PRODUCT FROM AN ELECTROLYSIS SYSTEM

[75] Inventors: Melvin S. Cook; George E. Atwood, both of Tucson, Ariz.

[73] Assignee: Duval Corporation, Tucson, Ariz.

[22] Filed: Aug. 11, 1975

[21] Appl. No.: 603,394

[52] U.S. Cl. ..... 204/10; 204/105 R; 204/107; 204/273; 204/275

[51] Int. Cl.[2] ..... C25C 1/12; C25C 15/08

[58] Field of Search ..... 204/107, 105 R, 112–113, 204/106, 109, 111, 114, 118, 10, 198, 273, 275

[56] References Cited

UNITED STATES PATENTS

| | | | |
|---|---|---|---|
| 1,069,169 | 8/1913 | Parker | 204/130 |
| 2,164,710 | 7/1939 | Hatch | 204/198 |
| 2,216,167 | 10/1940 | Fisher | 204/10 |
| 3,414,486 | 12/1968 | Nordblom et al. | 204/10 |
| 3,543,936 | 12/1970 | Abson et al. | 204/149 |
| 3,699,985 | 10/1972 | Faust | 204/198 |
| 3,785,944 | 1/1974 | Atwood et al. | 204/107 |

*Primary Examiner*—R. L. Andrews
*Attorney, Agent, or Firm*—Delmar L. Sroufe; Frank B. Pugsley; Larry B. Feldcamp

[57] ABSTRACT

In an electrolysis system capable of producing particulate crystalline product having limited adherence to the cathodes, a process and apparatus for the continuous recovery of said product directly from the electrolytic cell tank substantially uncontaminated by adhering electrolyte comprising the agitation of the electrolyte to effectively influence and contribute to the control of the crystalline product size and density as well as the structural competence of the dendrites and to cause said product to separate from the cathodes, the collection of the particulate crystalline product on a conveyor transport system located in the bottom part of the electrolytic cell tank, the continuous removal pf the particulate crystalline product from the electrolytic cell tank by means of the conveyor transport system, and the transportation of the crystalline particulate product through a washing zone prior to its removal from the electrolytic cell tank to substantially displace the electrolyte liquor from the particulate crystalline product.

27 Claims, 4 Drawing Figures

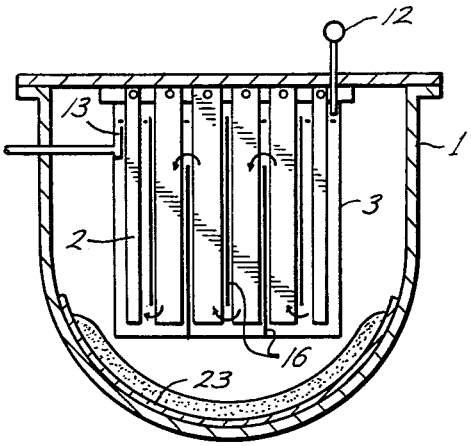
Fig. 2
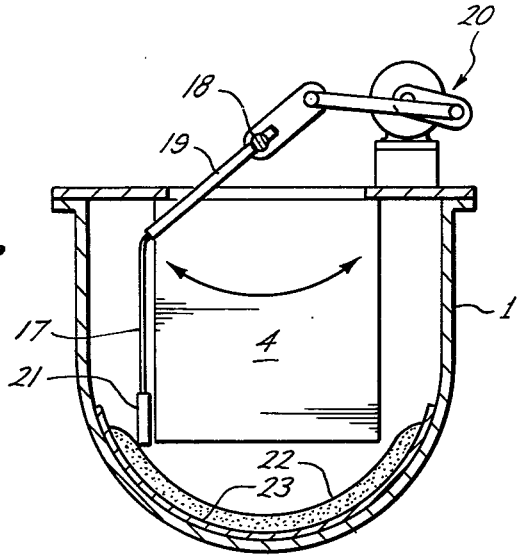
Fig. 3
Fig. 4
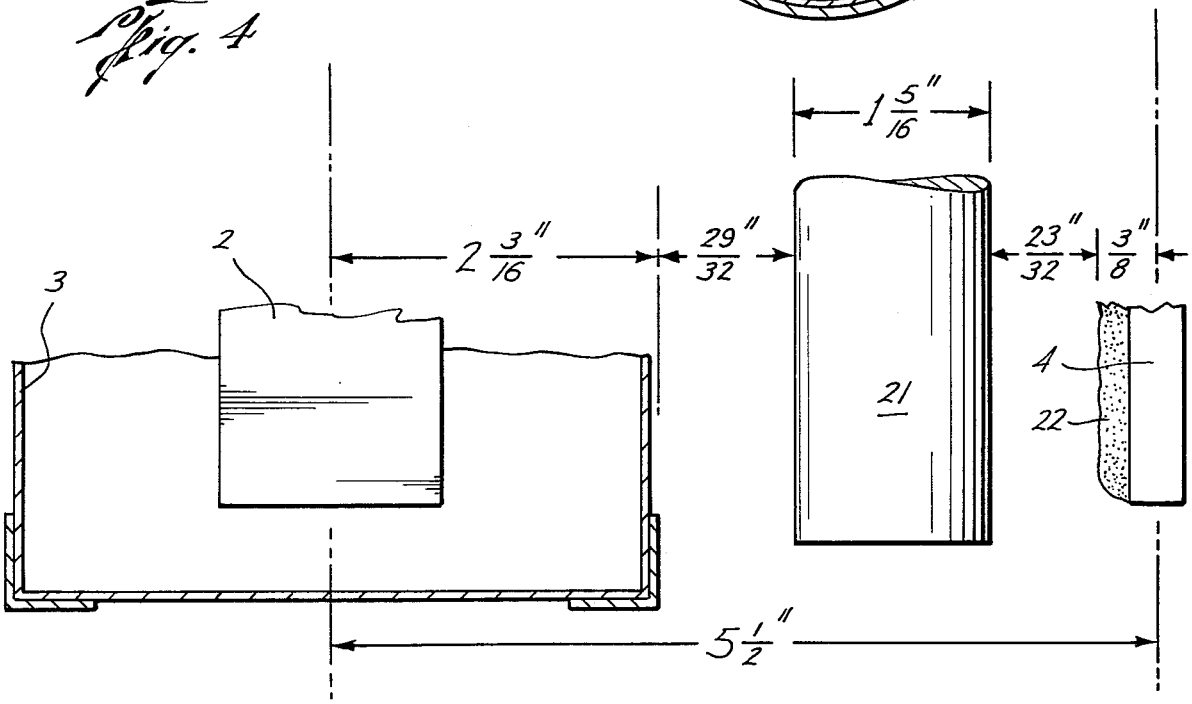

PROCESS AND APPARATUS FOR THE RECOVERY OF PARTICULATE CRYSTALLINE PRODUCT FROM AN ELECTROLYSIS SYSTEM

BACKGROUND OF THE INVENTION

This invention relates generally to the process of crystallization, and more specifically to a system capable of producing a particulate product. For such a system, this invention reveals a unique means of achieving continuous recovery and removal of said product from the production units, substantially uncontaminated by adhering mother liquor.

The application of this invention to an electrolysis system capable of producing a particulate crystalline product, having limited adherence to the surface of the electrode, provides for advantageous liberation from the restraints of conventional electro-plating procedures, including: (1) the requirement for product "starting sheets", including their preparation and handling for installation to initiate the production, followed by their removal to recover the production; and (2) the requirement for process control to obtain production plating that is smooth, densely crystalline and strongly adherent, with the absence of voids and the attendant occlusion of electrolyte. This latter requirement imposes a severe limitation on production current density, even with the benefit of additives, colloquially referred to as "plater-aids".

SUMMARY OF THE INVENTION

In an electrolysis system capable of producing a particulate crystalline product having limited adherence to the surface of the cathodes, this invention provides a means of continuous recovery of the product from the electrolytic cells substantially uncontaminated by adhering electrolyte as follows:

1. Mechanically activated "sweep" agitators traverse the active surfaces of each cathode at an established clearance therefrom to accomplish:
   a. Controlled agitation stirring of the electrolyte to:
      1. Establish and maintain the desired chemical homogeneity of the electrolyte, and
      2. Effectively influence and contribute to the control of the size and form of the crystalline growth at the cathodes.
   b. Positive sweeping of crystalline product from the cathode surfaces, indirectly by solution flow energy due to the agitation effect, and directly by contact of the agitators with crystalline growths extending into the travel path, thus providing for:
      1. Continuous "harvesting" of the crystalline product (for gravity sedimentation onto the collection and transport system) without handling or disturbing the cathodes; and
      2. Positive limitation on the crystalline growth from the cathode faces (as dendrites), thereby preventing an incursion into the anode zones with resultant short circuiting and other possible disadvantages.
2. A collection and transport system provides for recovery and removal of crystalline product from the electrolysis cells.
3. In conjunction with the collection and transport system, the electrolyte is displaced from the surface of the recovered crystalline product, prior to its removal from the electrolytic cells, by establishing liquids of various specific gravities in stratified layers in accordance with their relative specific gravities. The stratification of the liquids can remain adequately stable if physically disturbing influences are positively controlled. Accordingly, this invention reveals the means whereby:
   a. A chemically suitable liquor, or liquors, having a lower specific gravity than the given electrolyte can be "floated" as a layer or layers on the surface thereof.
   b. The particulate crystalline product is transported from the body of the electrolyte "mother liqor" upward into and through the layer of lower specific gravity liquor.
   c. Under the influence of gravity the entrained heavier electrolyte solution movement is downward, relative to that of the lower gravity liquid, which thereby displaces the electrolyte from the interstices and surfaces of the particulate crystalline product as it is transported upward through the supernatant layer.
   d. The interface between the stratified layers of liquids can remain practically undisturbed over prolonged periods of time by restricting the lineal velocity of the product transport system. An important innovative concept of this invention is the discovery of the importance of the relationship between the gravity settling velocity of the electrolyte liquor in the wash liquor and the counter influence of the upward velocity of the transport conveyor. This accounts for the unexpectedly positive, in place, displacement washing effect that can be achieved consistent with acceptable and practicable product conveying capacity in accordance with the teaching of this invention.
   e. Some intermixing of the stratified liquids will inevitably occur; however, the time span for this to take place can be extended, as revealed herein, to provide practical operating periods before unacceptable contamination of the wash liquor, or liquors, occurs, thus necessitating their replacement.
   f. When the overall process operating material balance permits, liquor or liquors of suitable composition and specific gravity required for makeup can be established as the components of the stratified wash system into which makeup quantities useful for process material balance maintenance are periodically or continuously injected, thus providing positive hydraulic displacement in opposition to the intermixing contamination tendency associated with the upward moving product solids. By this means, unacceptable contamination of the liquor or liquors can be postponed practically indefinitely.

The application of this invention to an electrolysis system capable of producing a particulate crystalline product is generally feasible with respect to the transition metals and group IB and IIB metals as conventionally arranged in the periodic table of the elements. Such application is most certainly feasible with respect to iron, cobalt, nickel, copper, silver, gold, palladium zinc, platinum, cadmium and mercury.

A PREFERRED EMBODIMENT OF THE INVENTION

U.S. Pat. No. 3,785,944 discloses a hydrometallurgical process for the recovery of copper wherein copper containing materials are chemically treated in a chloride system by which the copper is ultimately recovered as electrolytic copper. It is therein revealed that the electrolysis of a metal chloride precipitates the metal at the cathode together with the release of the chloride ion at the anode. By presenting the metal chloride in the lower valence state for electrolysis (as cuprous chloride in the case of copper) and limiting the electrolytic precipitation at the cathode to no more than one-half of the lower valence metal chloride present in the electrolyte feed solution, the chloride ion simultaneously released at the anode oxidizes the remaining half of the lower valence metal chloride in the electrolyte solution (to cupric chloride in the case of copper). Thus, electrolysis in the chloride system conducted in this manner minimizes the disadvantageous polarization effect of gas released at the anode that plagues electrolysis, for example, in the sulfate system. This avoidance of significant gas polarization and its accompanying, drastically adverse effect on electrical efficiency permits operation of the chloride system at phenomenally high electric current densities. Such operation at increasing current density results in a corresponding increasing tendency for change in the crystalline form of the metal deposited at the cathode: from the smooth surfaced densely crystalline form at lower current densities to rough surfaced, dendritic, and ultimately loosely adherent dendritic clusters "growing thickly" over the active face of the cathode at higher current densities. This constitutes an electrolysis system capable of producing a crystalline particulate product having limited adherence to the surface of the cathodes, which system the present invention is designed to serve. A principal advantage of such a high current density electrolysis system is the higher productivity per unit area of cathode with the attendant proportionally significant economic gains from reduced capital requirements for electrolysis equipment and product inventory retained in the process.

BRIEF DESCRIPTION OF THE DRAWINGS

In the accompanying drawings,

FIG. 2 is a vertical section of an electrolytic cell showing the anode and diaphragm configuration.

FIG. 3 is a vertical section of an electrolytic cell showing the cathode and agitator configuration.

FIG. 4 is a vertical section of an electrolytic cell showing the spatial relationships between cathode, anode, agitator, and diaphragm components.

DESCRIPTION OF THE PREFERRED EMBODIMENT

Figure 1:
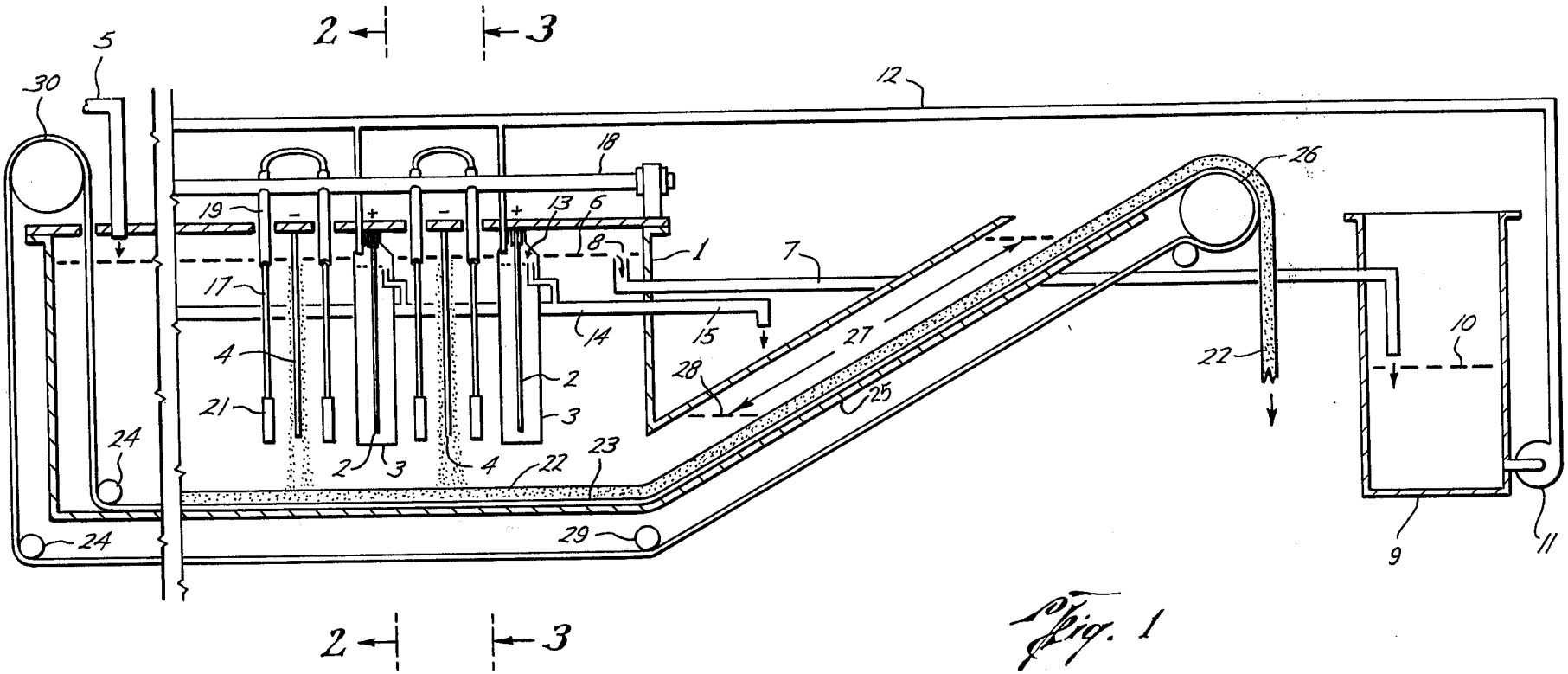
FIG. 1 is a vertical section of a series of electrolytic cells taken along their longitudinal axis.

In the electrolysis of cuprous chloride solution for the recovery of metallic copper, a series of electrolytic cells is used as illustrated in FIG. 1. The cells are contained in and supported by a rectangular shaped tank 1, with a nonconductive and corrosion resistant liner. Each cell consists of an inert anode 2, a diaphragm 3 which surrounds the anode, and a cathode 4.

The pregnant electrolyte feed solution 5, which consists primarily of cuprous chloride and a small amount of cupric chloride in an aqueous solution, is introduced into the catholyte 6. After being circulated in contact with the cathodes the electrolyte (catholyte) is removed via weir 8 through conduit 7 and is discharged into anolyte sump 9. The anolyte solution 10 is transferred by pump 11 through conduit 12 and discharged into the anolyte compartment formed by diaphragm 3.

The anolyte solution in the anolyte compartment overflows anolyte level control weir 13 and the raffinate 14 (spent electrolyte) is discharged from the electrolytic cells through conduit 15.

Electrolysis conducted in the system, as revealed above, results in the transfer of copper ions to the cathode to be deposited thereon as metallic copper and the simultaneous transfer of chloride ions to the anode to be released in the presence of the anolyte solution, thereby oxidizing the cuprous chloride therein to cupric chloride.

The relative levels of the catholyte and anolyte in their respective compartments are controlled by weir-type arrangements to maintain a positive hydraulic gradient from the catholyte compartment to the anolyte compartment. In order to preclude the counterflow of anolyte into the catholyte compartment, anolyte weir 13 is maintained lower than catholyte weir 8. If the anolyte solution containing cupric chloride were permitted to flow into the catholyte compartment, it would tend to re-dissolve copper in the catholyte compartment.

In FIG. 2 the anolyte flow within the anolyte compartment formed by diaphragm 3 is directed by the use of baffles 16 to provide complete flowing contact and agitation at the anode face. The baffles are attached to and support the diaphragm while forming flow channels for the anolyte solution.

The electrolysis current density is controlled at a level such that the copper deposited at the cathodes is loosely adherent thereto in the form of crystalline copper. To assure that this crystalline copper is dislodged from the cathodes, as illustrated in FIG. 1, flexible agitators 17 are mounted on both sides of each cathode 4 to traverse the active surfaces at an established clearance therefrom. The agitators are attached to shaft 18 which is caused to oscillate by motor 20 which is illustrated in FIG. 3. Each agitator arm consists of a fiberglass tube 19 into which is inserted rubber cord 17. An additional fiberglass tube 21 may be suspended from the rubber cord if desired.

The crystalline copper 22 is collected on flexible conveyor belt 23 as it falls from the cathodes. As is shown in FIGS. 2 and 3 the conveyor belt 23 provides a concave trough extending the full width of the electrolytic cell tanks so as to collect all the copper that is dropped from the cathodes 4. The conveyor belt 23 is positioned and guided in the electrolytic cell tank by idlers 24.

From the bottom of tank 1, the conveyor belt 23 then moves upward through as inclined rectangular conduit or spout 25 which is approximately the width of the tank. The belt which is caused to be flat in inclined conduit 25 is guided and moved via head pulley 26. In the relative "seclusion" of the inclined conduit 25 a displacement washing zone 27 is maintained in the upper portion thereof in which liquids are established in stratified layers in accordance with their relative specific gravities. The displacement solution interfaces with the catholyte solution at 28.

As the crystalline copper product passes through the washing zone the catholyte solution entrained with it is subjected to removal by displacement. The crystalline copper, thus washed, is then discharged into a hopper or other collection device, not shown, as the conveyor belt 23 passes over pulley 26. The conveyor belt is then guided by idlers 29 to pulley 30 where the belt is then returned into the opposite end of tank 1.

Contrary to the operation of conventional electrolytic cells, which usually operate at relatively low current densities in order to improve the plating of the metallic copper at the cathodes, this embodiment of the present invention permits the use of current densities in the range from about 800 amps/m² to about 4000 amps/m². The purpose of operating at these higher current densities is to produce copper in a form which is normally avoided in the operation of conventional electrolytic cells, that is, the formation of dendritic crystalline copper that is loosely adherent to the cathodes.

By being able to operate at higher current densities the number of electrolytic cells required for the production of metallic copper is proportionally lower. Obviously, the capital cost for electrolytic cells is thus significantly reduced. Although the operating cost is increased by higher voltage associated with the use of higher current density, this is partially offset by the decreased maintenance cost resulting from the utilization of fewer cells as well as the advantages resulting from the use of permanent rather than removable cathodes.

It has been discovered that the crystalline copper which loosely adheres to the cathodes can be removed therefrom by agitation of the catholyte. Flexible agitators on each side of a cathode sheet are used to agitate the catholyte. These agitators also provide for complete mixing of the catholyte so that the copper concentration therein is essentially homogeneous. It has also been discovered that the intensity of agitation thus provided can advantageously influence and contribute to the control of the size and density as well as the structural competence of the crystalline growth at the cathode. Increased intensity of agitation tends to promote the formation of structurally competent dendritic crystalline product.

In addition, the agitators provide positive means for limitation of the extent of crystalline growth from the face of the cathode, thereby preventing penetration of the diaphragm and the development of an electrical short circuit between adjacent cathodes and anodes, since the agitators are designed to completely sweep the electrically active area between each pair.

Although no specific construction is required, the agitators should be flexible rather than rigid. Alignment problems leading to the frequent rupture or tearing of diaphragms can result from the use of rigid agitators. Moreover, rigid agitators wear out more rapidly than flexible ones and are generally more expensive.

A preferred embodiment of the present invention provides that the agitator assembly be comprised of flexible vertical arms extending from a horizontal shaft positioned above the electrolytic cells. Each agitator arm consists of a fiberglass tube to which is attached a rubber cord. It has been found advantageous to attach an additional piece of fiberglass tubing, which may be weighted, to the bottom of the rubber cord. Each flexible arm, positioned to assure operating clearance, extends sufficiently beyond the complete length of the cathode sheet so that the oscillating motion of the arm will cover the entire active area of one side of the cathode.

It should be understood that the function of the agitators, as revealed herein, is primarily to generate solution flow energy in conjunction with stirring and mixing action in close proximity to the cathode surfaces whereby the loosely adherent particulate crystalline product is dislodged therefrom. A second function is the positive limitation of the ultimate extent of the crystalline growth from the cathode, which is assured by direct impact therewith by the agitator as determined by its established operating clearance. Similarly, actual rubbing contact of the agitator with the surface of the diaphragm is avoided by the established operating clearance therefrom.

For the sake of lowering the electrical resistance of the electrolysis system, the distance between the electrodes should be minimized. This consideration influences the operating clearances of the agitator arms as established. In this regard, FIG. 4 illustrates a set of practical operating spatial dimensions between adjacent electrodes.

The flexible arm agitators are oscillated at frequencies from about 8 to about 24 cycles per minute. In general, the speed is increased at higher current densities. Above 24 cycle per minute, it has been found that undersirable oxidation of the cuprous chloride to cupric chloride occurs. Preferably the oscillation is conducted at about 10 to 14 cycles per minute.

The conveyor positioned in the bottom of the electrolytic cell tank is used to collect the crystalline copper which falls from the cathodes, and to transport it from the tank. The conveyor, which can be of any suitable construction, preferably comprises a flexible belt which is concavely curved to form a trough with its edges sealed under a rubber skirt on the longitudinal sides of the tank, and the center of the belt touching and supported by a plastic "slide" cover located on the centerline of the bottom of the tank. This arrangement minimizes the amount of crystalline copper that will penetrate underneath the belt.

The conveyor, in accordance with the present invention, is designed so that maintenance can be performed without interrupting the electrolysis operation. The submerged idlers for the conveyor are mounted on framework extending out of the electrolyte liquor and thereby can be easily replaced.

The conveyor transporting the crystalline copper departs from the tank, proper, via an inclined conduit which extends upward from the bottom end of the electrolytic cell tank at a maximum angle of about 45°. The width of the inclined conduit is dimensioned to permit the transition of the conveyor surface contour from that of the concave trough for collection of the crystalline product within the tank to the relatively expanded contour of the flattened surface of the belt for transport through the washing zone in the upper portion of the inclined conduit.

In the copper chloride electrolysis system of the said preferred embodiment, the catholyte entrained with the collected and transported crystalline product consists of residual cuprous chloride in a solution nearly saturated with one or more saline metal chlorides, such as, by way of example, sodium chloride, potassium chloride, magnesium chloride or calcium chloride. Displacement of this entrained residual liquor can be achieved, in accordance with this invention, by lower gravity liquid or liquids "floated" in stratified sequence on the surface of the catholyte electrolyte. The composition of these lower gravity liquids can advantageously be related to the make-up requirements for maintenance of the overall process liquor material balance. For example, an aqueous liquor containing one or more saline metal chlorides, useful for material balance makeup, and necessary to avoid precipitation of cuprous chloride, with the specific gravity adjusted by the concentration of the contained chloride to the desired differential with respect to the specific gravity of the electrolyte, can be floated directly thereon and maintained as a suitable layer to provide for displacement of the copper bearing electrolyte from the copper product leaving the electrolytic cell tank. Such layer may be maintained by periodic or continuous injection thereinto of makeup liquor in quantities useful for process material balance maintenance. This input of liquid provides positive hydraulic displacement in opposition to the intermixing contamination tendancy associated with the upward moving product solids on the conveyor. Additionally, and similarly useful for process material balance requirements, a liquid layer consisting of water can be floated and maintained on the saline metal chloride layer with the resultant displacement washing effect leaving the copper product substantially free of soluble contaminants. This unique procedure whereby these contaminants with respect to the purity of the product are thus retained as valuable ingredients within the process liquor in conjunction with the required makeup for maintenance of the material balance of the process liquor system constitutes an important feature of the teaching of this invention.

The conveyor travel speed is preferably maintained as low as possible for the benefit of the displacement washing accomplishment. For the preferred embodiment, herein described, pilot development tests designed and conducted to examine the correlation of transport conveyor speed, product loading on the conveyor, and displacement washing accomplishment have revealed entirely practicable working limits within which acceptable operating results can be achieved.

TABLE I

DOUBLE - INTERFACE DISPLACEMENT WASH ON CELL CONVEYOR

| Test No. | Product Loading lb./hr. | Conveyor Velocity in./min. | Relative % of Residual Catholyte with Product* |
|---|---|---|---|
| 1 | 585 | 4 | 1.73 |
| 2 | 585 | 3 | 1.68 |
| 3 | 585 | 2 | 1.19 |
| 4 | 585 | 1 | 0.37 |
| 5 | 295 | 4 | 2.70 |
| 6 | 295 | 3 | 1.86 |
| 7 | 295 | 2 | 1.63 |
| 8 | 295 | 1 | 0.36 |
| 9 | 295 | 1 | 0.22 |
| Lower solution | — Saturated sodium chloride-aqueous, 18 inches vertical depth. | | |
| Upper solution | — Fresh water, 19¾ inches vertical depth. | | |
| Production | — Copper crystals. | | |

*Calculated on a potassium basis by dividing the concentration of potassium in the dried final product by the concentration of potassium in the catholyte.

The data tabulation indicates that the displacement of the electrolyte from the product solids in the washing system is a function of conveyor velocity and is essentially independent of product loading. Data were taken during operation of an experimental prototype cell conveyor mechanism with the washing-discharge inclined conduit inclined at 25° above horizontal.

The displacement phenomenon illustrated in the preceding experimental data will hold for alternate systems with actual washing efficiency being influenced by prevailing viscosity, product solids configuration and surface texture, and solution concentration parameters. That is, for a given alternate system, an anomoeous reduction in electrolyte carryover with the product will be associated with a reduction of conveyor velocity below an experimentally established critical value.

We claim:

1. In an electrolysis system capable of producing a particulate crystalline product a particulate crystalline product having limited adherence to the surface of the cathodes, a process for the continuous recovery of said product directly from the electrolytic cell tank substantially uncontaminated by adhering electrolyte, comprising:

a. Agitating the electrolyte liquor so as to effectively influence and contribute to the control of the crystalline product size and density as well as the structural competence of the dendrites and to cause said product to separate from the cathodes;

b. Collecting the particulate crystalline product separated from the cathodes on a conveyor transport system located in the bottom part of the electrolytic cell tank;

c. Continuously removing the particulate crystalline product from the electrolytic cell tank by means of the conveyor transport system; and d. Transporting the particulate crystalline product through a washing zone prior to its removal from the electrolytic cell tank so as to displace the electrolyte liquor from the particulate crystalline product.

2. The process of claim 1 in which the electrolysis system is for the recovery of metallic copper from copper chloride liquor.

3. The process of claim 2 in which the electrolyte liquor is agitated with a flexible arm on each side of each cathode with said agitator arms oscillated through an arc sweeping the entire electrically active surface of each cathode at an established clearance therefrom.

4. The process of claim 3 in which the flexible arm agitators are oscillated at a rate high enough to effectively influence and contribute to the control of the crystalline product size and density as well as the structural competence of the dendrites of the crystalline product but below the rate at which undesirable oxidation of the cuprous component of the electrolyte occurs.

5. The process of claim 3 in which the flexible arm agitators are oscillated at a frequency in the range from about 8 to 24 cycles per minute.

6. The process of claim 2 in which an aqueous liquor containing saline metal chloride as required to avoid precipitation of cuprous chloride, and chemically suitable for use as makeup for process material balance maintenance, with the specific gravity adjusted by concentration of contained chloride to the desired differential with respect to the specific gravity of the electrolyte, is established in the washing zone as a stratified layer on the surface of said electrolyte and maintained by injection thereinto of additional said liquor, thereby providing positive hydraulic effect for displacement washing as well as makeup for process material balance requirements.

7. The process of claim 6 in which the saline metal chloride is selected from the group consisting of sodium chloride, potassium chloride, magnesium chloride, calcium chloride and mixtures thereof.

8. The process of claim 6 in which water is established as stratified layer above the saline metal chloride layer in the washing zone and maintained by injection thereinto of additional water, thereby providing positive hydraulic effect for final displacement washing to substantially free the copper product of soluble contaminants as well as providing makeup for process material balance requirements.

9. The process of claim 2 in which the current density for electrolysis is at least sufficient to provide for particulate crystalline copper deposited at the cathodes that is loosely adherent thereto.

10. The process of claim 2 in which the current density for electrolysis is in the range from about 800 to about 4000 amps per square meter.

11. The process of claim 2 in which the conveyor transport velocity is controlled at less than about 2 inches per minute in order to assure substantially complete displacement of electrolyte from the product.

12. The process of claim 1 in which at least one chemically suitable liquor of lower specific gravity than the electrolyte is established and maintained in the washing zone as a stratified layer on the surface of the electrolyte to provide for the displacement washing effect.

13. The process of claim 12 in which liquor of lower specific gravity than the electrolyte and of chemically suitable composition for use as make-up for process material balance maintenance is established as a component of the stratified wash system and maintained by injection thereinto of additional said liquor, thereby providing positive hydraulic effect for displacement washing as well as make-up for process material balance requirements.

14. The process of claim 12 in which the conveyor transport velocity is limited to effectively displace the electrolyte liquor from the product with minimal physical disturbance of the liquors in the washing zone.

15. The process of claim 1 in which a plurality of chemically suitable liquors of sequentially lower specific gravities than the electrolyte is established and maintained as sequentially stratified layers on the electrolyte surface to provide for the displacement washing effect in the washing zone.

16. The process of claim 15 in which liquors of lower specific gravities than the electrolyte and of chemically suitable composition for use as make-up for process material balance maintenance are established as components of the stratified wash system and maintained by injection thereinto of additional said liquors, thereby providing positive hydraulic effect for displacement washing as well as make-up for process material balance requirements.

17. The process of claim 1 in which the washing zone is established in the upper portion of a an inclined conduit extending from the bottom of the electrolytic cell tank at an angle of not more than about 45° above horizontal.

18. The process of claim 17 in which the conveyor transport system includes a flexible conveyor belt which moves continuously through the electrolytic cell tank, near the bottom, and thence through the inclined conduit extending therefrom with the washing zone established therein, said belt forming a concave collecting and carrying surface within the tank and a flat carrying surface within the inclined conduit.

19. The process of claim 1 in which the electrolyte liquor is agitated with a flexible arm on each side of each cathode with said agitator arms oscillated through an arc sweeping the entire electrically active surface of each cathode at an established clearance therefrom.

20. The process of claim 1 in which the product is copper.

21. In an electroysis system for the recovery of metallic copper from a copper chloride liquor, a process for the continuous recovery of said product directly from the electrolytic cell tank substantially uncontaminated by adhering electrolyte, comprising:

a. Controlling the current density for electrolysis at a level at least sufficient to provide for particulate crystalline copper deposited at the cathode that is loosely adherent thereto;

b. Agitating the electrolyte liquor with a flexible arm on each side of each cathode with said agitator arms oscillated through an arc sweeping the entire electrically active surface of each cathode at an established clearance therefrom;

c. Oscillating the agitator arms at a rate high enough to effectively influence and contribute to the control of the crystalline product size and density as well as the structural competence of the dendrites of the crystalline product but below the rate at which undesirable oxidation of the cuprous component of the electrolyte occurs;

d. Collecting the particulate crystalline product separated from the cathodes on a conveyor transport system located in the bottom part of the electrolytic cell tank;

e. Continuously removing the particulate crystalline product from the electrolytic cell tank by means of the conveyor transport system;

f. Transporting the particulate crystalline product through a washing zone containing a stratified layer of saline metal chloride solution, necessary to avoid cuprous chloride precipitation and chemically compatible with and having a lower specific gravity than the electrolyte liquor, to diplace the electrolyte liquor from the particulate crystalline product;

g. Controlling the conveyor transport velocity at a limited rate to effectively displace the electrolyte liquor from the product with minimal disturbance of the stratification of liquors in the washing zone;

h. Providing an aqueous liquor containing saline metal chloride chemically suitable for use as makeup for process material balance maintenance, and required to avoid precipitation of cuprous chloride, with the specific gravity adjusted by concentration of contained chloride salt to the desired differential with respect to the specific gravity of the electrolyte, said liquor to be established in the washing zone as a stratified layer on the surface of said electrolyte and to be maintained by injection thereinto of additional said liquor, thereby providing positive hydraulic displacement effect for washing as well as makeup for process material balance requirements; and, i. Providing for water to be established as a stratified layer above the saline metal chloride liquor layer in the washing zone and to be maintained by injection thereinto of additional water, thereby providing positive hydraulic effect for final displacement washing to substantially free the copper product of soluble contaminants as well as providing makeup for process material balance requirements.

22. The process of claim 21 in which the flexible arm agitators are oscillated at a frequency in the range from about 8 to about 24 cycles per minute and the conveyor transport system is moved at less than 2 inches per minute.

23. The process of claim 21 in which the flexible arm agitators are oscillated at a frequency from about 10 to about 14 cycles per minute and the conveyor transport system contains a conveyor belt which is moved at about 1 inch per minute.

24. In an electrolysis system capable of producing a particulate crystalline product having limited adherence to the surface of the cathodes, the improvements comprising:

a. A flexible arm on each side of each cathode with said arms being attached to and oscillating about a horizontal shaft attached to the electrolytic cell tank;

b. An inclined conduit extending from the bottom end of the electrolytic cell tank extending upward at an angle not exceeding about 45° to a height of at least that of the cathodes and anodes; and c. A conveyor transport system extending across the bottom of the electrolytic cell tank and through the inclined conduit for removing the particulate crystalline product from the electrolysis system.

25. The electrolysis system of claim 24 in which the flexible arms extend the full length of the cathodes so that the entire electrically active surface of the cathodes is swept by the oscillating flexible arms.

26. The electrolysis system of claim 24 in which the conveyor transport system contains a flexible conveyor belt which is concave in the electrolytic cell tank and flat in the inclined conduit.

27. In an electrolysis system capable of producing particulate crystalline copper having limited adherence to the surface of the cathodes, the improvements comprising:

a. A flexible arm on each side of each cathode with said arms being attached to and oscillating about a horizontal shaft attached to the electrolytic cell tank and extending the full length of the cathodes so that the entire electrically active surface of the cathodes will be swept by the oscillating flexible arms;

b. An inclined conduit extending from the bottom end of the electrolytic cell tank extending upward at an angle not exceeding about 45° to a height of at least that of the cathodes and anodes; and c. A conveyor transport system extending across the bottom of the electrolytic cell tank and through the inclined conduit for removing the crystalline copper from the electrolytic cell tank, with said transport system containing a conveyor belt which is concave in the electrolytic cell and flat in the inclined conduit.

* * * * *

UNITED STATES PATENT AND TRADEMARK OFFICE

CERTIFICATE OF CORRECTION

PATENT NO. : 4,025,400

DATED : May 24, 1977

INVENTOR(S) : Melvin S. Cook and George E. Atwood

It is certified that error appears in the above-identified patent and that said Letters Patent are hereby corrected as shown below:

Under ABSTRACT, line 13, "pf" should read -- of --

Column 1, lines 41, 44, "1" and "2" should be -- (1) and (2) --

Column 1, lines 53, 56, "1" and "2" should be -- (1) and (2) --

Column 3, line 19, a comma should be inserted after "surfaced".

Column 9, line 47, after "portion of" delete "a"

Column 9, line 66, "electroysis" should be -- electrolysis --

Column 10, line 32, the word "diplace" should be -- displace --

Signed and Sealed this

*Sixth* Day of *September 1977*

[SEAL]

*Attest:*

RUTH C. MASON
*Attesting Officer*

LUTRELLE F. PARKER
*Acting Commissioner of Patents and Trademarks*

UNITED STATES PATENT AND TRADEMARK OFFICE

CERTIFICATE OF CORRECTION

PATENT NO. : 4,025,400

DATED : May 24, 1977

INVENTOR(S) : Melvin S. Cook and George E. Atwood

It is certified that error appears in the above-identified patent and that said Letters Patent are hereby corrected as shown below:

Column 7, lines 64-65, "anomoeous" should read -- anomalous --

Column 8, lines 1-2, delete -- a particulate crystalline product --

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*